United States Patent [19]

Seitz et al.

[11] 4,271,798

[45] Jun. 9, 1981

[54] ALTERNATE CLOSED LOOP CONTROL SYSTEM FOR AN AIR-FUEL RATIO CONTROLLER

[75] Inventors: William R. Seitz, Royal Oak; Chun K. Leung, Farmington Hills, both of Mich.

[73] Assignee: The Bendix Corporation, Southfield, Mich.

[21] Appl. No.: 955,728

[22] Filed: Oct. 27, 1978

[51] Int. Cl.[3] ..... F02D 5/00

[52] U.S. Cl. ..... 123/419; 123/436; 60/276

[58] Field of Search ..... 123/119 EC, 32 EA, 32 EE, 123/419, 436; 60/276, 285

[56] References Cited

U.S. PATENT DOCUMENTS

| | | | |
|---|---|---|---|
| 3,664,311 | 5/1972 | Endo | 123/32 EA |
| 3,745,768 | 7/1973 | Zechnall et al. | 60/276 |
| 3,784,843 | 1/1974 | Gustus | 307/117 |
| 3,789,816 | 2/1974 | Taplin | 123/119 R |
| 3,872,846 | 3/1975 | Taplin et al. | 123/119 A |
| 3,926,154 | 12/1975 | Williams | 60/276 |
| 3,938,075 | 2/1976 | Reddy | 340/52 R |
| 3,938,479 | 2/1976 | Oberstadt | 123/32 EA |
| 3,939,654 | 2/1976 | Creps | 60/276 |
| 3,948,228 | 4/1976 | Luchaco | 123/32 EA |
| 3,949,551 | 4/1976 | Eichler et al. | 60/274 |
| 3,964,457 | 6/1976 | Coscia | 123/119 F |
| 3,990,411 | 11/1976 | Oberstadt et al. | 60/276 |
| 3,998,189 | 12/1976 | Aoki | 123/32 EA |
| 4,003,350 | 6/1977 | Eisele et al. | 123/32 EA |
| 4,027,477 | 4/1976 | Storey | 60/276 |
| 4,092,955 | 6/1978 | Reddy | 123/32 EA |
| 4,094,186 | 6/1978 | Wessel | 123/119 EC |
| 4,096,834 | 6/1978 | Norimatsu et al. | 123/32 EE |
| 4,103,649 | 8/1978 | Matumoto et al. | 123/119 EC |
| 4,106,450 | 8/1978 | Norimatsu et al. | 60/285 |
| 4,132,200 | 1/1979 | Asano et al. | 123/119 EC |
| 4,140,086 | 2/1979 | Schnurle et al. | 60/285 |
| 4,153,023 | 5/1979 | Asano et al. | 123/119 EC |
| 4,155,335 | 5/1979 | Hosaka et al. | 123/119 EC |

*Primary Examiner*—Charles J. Myhre
*Assistant Examiner*—R. A. Nelli
*Attorney, Agent, or Firm*—Gaylord P. Haas, Jr.; Russel C. Wells; Paul J. Ethington

[57] ABSTRACT

A closed loop control system is disclosed for controlling the air-fuel ratio of an internal combustion engine. An oxygen sensor is connected into the control loop after engine warm up when the temperature has reached its operating temperature to maintain the air-fuel ratio close to the stoichiometric value. An engine roughness detector is connected into the control loop before the oxygen sensor has reached its operating temperature to maintain the air-fuel ratio close to a predetermined lean limit. A temperature sensor and switching means controlled thereby are provided to alternately connect the roughness detector and the oxygen sensor in the control loop.

4 Claims, 4 Drawing Figures

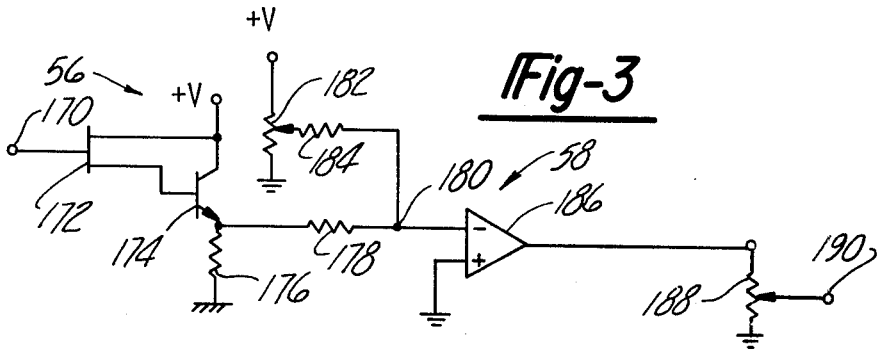
Fig-3
Fig-4
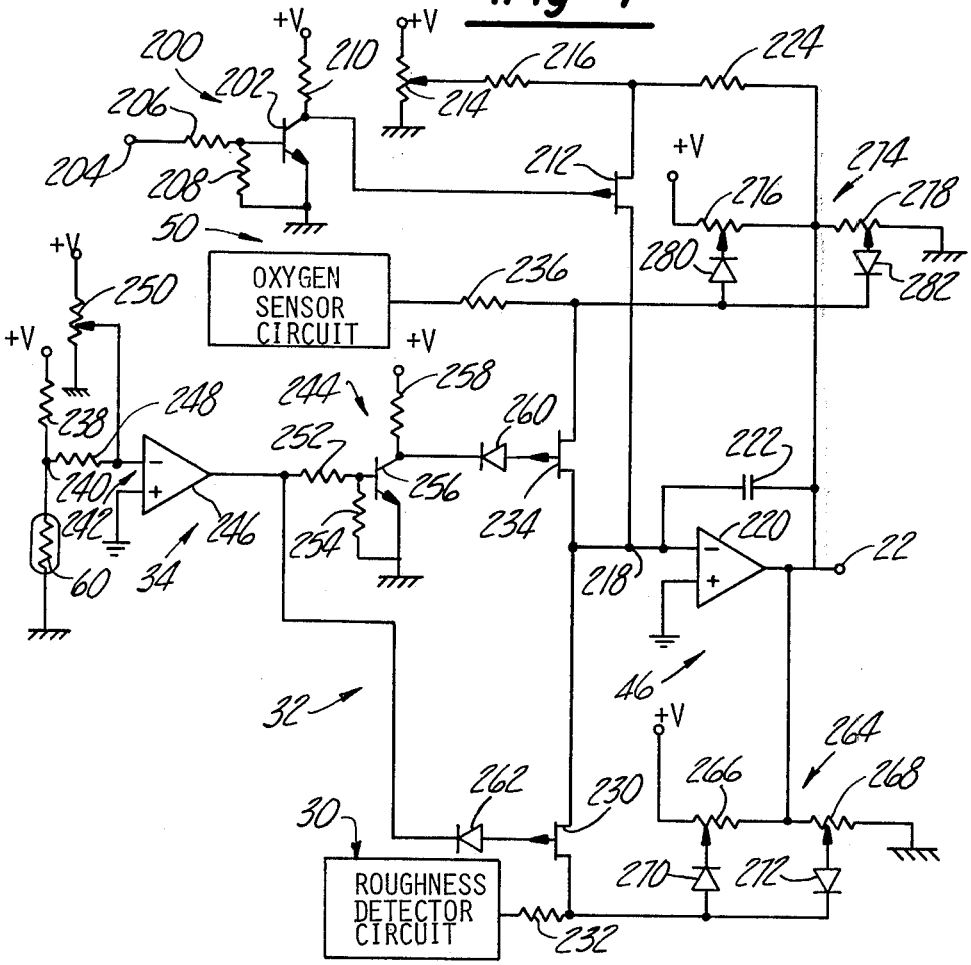

ALTERNATE CLOSED LOOP CONTROL SYSTEM FOR AN AIR-FUEL RATIO CONTROLLER

TECHNICAL FIELD

This invention relates to air-fuel ratio control systems for internal combustion engines and more particularly, it relates to improved means for producing a control signal for an air-fuel ratio controller.

BACKGROUND ART

The reduction of undesired emissions from internal combustion engines is commonly provided by the use of a catalytic converter in the exhaust gas path of the engine. In a two-way catalytic device, the catalyst is effective to cause oxidation of carbon monoxide and hydro-carbons in the exhaust gases. In a so-called three-way catalytic device, the catalyst also causes the reduction of nitrogen oxides. In the two-way catalytic device, the efficiency of the converter increases with increasing air fuel ratio in the region of the stoichiometric value i.e. the ratio at which the fuel and oxygen are proportional so that both would be completely consumed in perfect combustion. In the case of the three-way catalytic device, the optimum conversion efficiency for combined oxidation and reduction is obtained when the air-fuel ratio is maintained within a narrow range centered at the stoichiometric value. Preferably, for reduction of emissions, the air-fuel ratio should be maintained on the lean side of the stoichiometric value with a two-way catalytic device and with a three-way device, within a narrow band or window centered on the stoichiometric value.

Numerous control systems have been proposed for controlling the air-fuel ratio supplied to the engine in response to a measure of the composition of the exhaust gases. A typical arrangement uses a closed loop control system with an oxygen gas sensor in the exhaust gas passage for producing a control signal for modifying the air-fuel ratio. Presently known oxygen gas sensors, such as the zirconium oxide type sensor, are responsive to produce an electrical signal which accurately represents an oxygen content only if the gas sensor is above a certain temperature. When an engine is warming up after a cold start or when operating during a prolonged idle condition, the oxygen sensor will be below it's operating temperature. In this condition the closed loop control system with the oxygen sensor is unable to control the air-fuel ratio at the desired value. It has been proposed to overcome this problem by disabling the closed loop control system until the oxygen sensor has reached it's operating temperature. In the Oberstadt U.S. Pat. No. 3,938,479 the operating condition of the oxygen sensor is detected by monitoring the output signal and the closed loop control system using the oxygen sensor becomes operative only when the oxygen sensor is in an operative state. A system is disclosed in the Toelle et al U.S. Pat. No. 3,990,411 in which the closed loop system is operated to maintain the air-fuel ratio at a fixed or predetermined value for given engine operating conditions until the oxygen sensor is at the proper operating temperature.

While such prior art systems are highly effective for controlling the air-fuel ratio after the oxygen sensor becomes operative, there is a need for improved control of the air-fuel ratio during the warm-up period or during cold engine operation. There have been efforts to provide control of the air-fuel ratio during engine warm-up by using one control system and to provide control after engine warm-up by means of another control system. In the Williams U.S. Pat. No. 3,926,154, one control loop uses a carbon monoxide sensor and controls the air-fuel ratio durng engine warm-up and another control loop uses an oxygen sensor to control the air-fuel ratio after warm-up. In the Storey U.S. Pat. No. 4,027,477, a closed loop control system is disclosed with an oxygen sensor upstream of the catalytic converter and another oxygen sensor downstream of the catalytic converter. The first oxygen sensor reaches operating temperatures more quickly after engine start-up than the second sensor and means are provided to transfer control from the first sensor to the second sensor after the second sensor reaches operating temperature.

It is a general object of this invention to overcome the disadvantages of the prior art by providing alternately selectable closed loop control system for the air-fuel ratio during engine operation.

SUMMARY OF THE INVENTION

In accordance with this invention, a control system is provided for maintaining an air-fuel ratio which affords engine operation characterized by smooth running and low level emissions both during and after engine warm-up. This is accomplished by the combination of the first closed loop control system which is responsive to an engine running characteristic for air-fuel ratio control during engine warm-up operation and a second closed loop control system responsive to exhaust gas content for control of air-fuel ratio for post warm-up engine operation. In a preferred embodiment, the control loop for engine warm-up operation utilizes a feedback signal corresponding to engine roughness and the engine is operated in a lean-limit condition. After engine warm-up, the closed loop control utilizes a feedback signal corresponding to oxygen content in the exhaust gases to maintain the air-fuel ratio close to the stoichiometric value.

Further, in accordance with this invention, first and second control loops for air-fuel ratio control are alternately selected in accordance with an operating condition of the gas sensor so that one or the other control loop exercises the control of the air-fuel ratio under all engine operating conditions. This is accomplished by switching means which is directly or indirectly responsive to an operating condition of the gas sensor. A preferred arrangement uses a temperature sensor responsive to the engine temperature for controlling the switching means.

According to this invention, a system is provided for producing a control signal for an air-fuel ratio controller of an engine. The system comprises first means for producing a signal indicative of stable or smoothrunning engine operation and second means for producing a signal indicative of a gas content in the engine exhaust gas. Switching means are provided for selectively coupling the first means and the second means with the air-fuel ratio controller of the engine. Means are provided for operating the switching means to couple the first means with the controller before the gas sensor is operative and to couple the second means with the controller after the gas sensor is operative.

A more complete understanding of this invention will be obtained from the detailed description that follows taken with the accompanying drawings.

BRIEF DESCRIPTION OF THE DRAWINGS

FIG. 3 is a schematic diagram of an oxygen sensor circuit, and

FIG. 4 is a schematic diagram of the control system of this invention.

BEST MODE FOR CARRYING OUT THE INVENTION

Referring now to drawings, there is shown an illustrative embodiment of the invention in a control system for producing a control signal for an air-fuel ratio controller of an internal combustion engine. In this embodiment, a closed loop control system responsive to oxygen content in the exhaust gases is utilized for maintaining the air-fuel ratio close to the stoichiometric value during the post warm-up operation of the engine. During the warm-up operation of the engine, a closed loop control system responsive to engine roughness is utilized for maintaining the air-fuel ratio at or near the lean limit for stable or smooth running engine operation. In this illustrative embodiment, the engine is fitted with a fuel injection system; it will be appreciated that the invention is also applicable to a conventional carburetion system.

Figure 1:
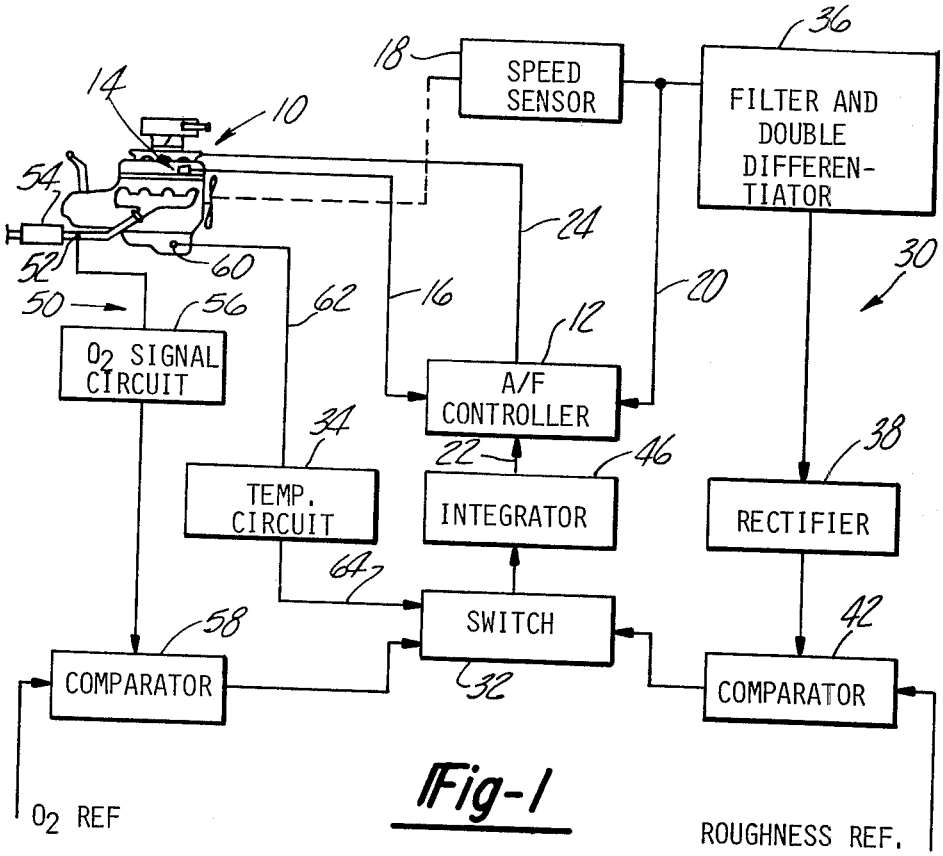
FIG. 1 is a block diagram of the invention.

Referring now to FIG. 1, the system of this invention is shown in block diagram for controlling the air-fuel ratio of an internal combustion engine 10 of an automotive vehicle. The system is comprised of an air-fuel ratio controller 12 which is adapted to control the quantity of fuel supplied by the individual fuel injectors of the engine on each injection cycle. The controller 12 is provided in a known manner with electrical input signals corresponding to selected engine operating conditions and is operative to compute the desired fuel quantity and generate fuel control pulses corresponding thereto. For this purpose, the engine is provided with a pressure sensor 14 in the intake manifold to provide a signal corresponding to manifold absolute pressure. The pressure signal from the sensor 14 is supplied through a conductor 16 to one input of the controller 12. The engine is also provided with a speed sensor 18 which is coupled with the crankshaft to provide a electrical signal corresponding to the engine crankshaft speed. This speed signal is applied through a conductor 20 to another input of the controller 12. The controller 12 also receives a control signal at another input on a conductor 22 which control signal is produced by the closed loop control systems of this invention. The controller 12 is operative to produce electrical output pulses on output conductors represented by line 24 which are connected to respective injectors on the engine. The output pulses on the conductors of line 24 have a duration which determines the time period during which the injectors cause fuel to be injected and hence the rate at which fuel is supplied to the engine. The control signal on conductor 22 produced by the closed loop control system of this invention is of variable value and effective to cause the controller to modulate the air-fuel ratio in accordance with the value of the control signal.

The closed loop control system of this invention for producing the control signal on conductor 22 will now be described with reference to the block diagram of FIG. 1. The system comprises an engine roughness control loop 30 and an oxygen control loop 50, which are alternately selectable for producing the control signal on conductor 22. The loops are selectable by a switching means 32 under the control of a temperature responsive circuit 34. The temperature responsive circuit 34 is adapted to control the switching means 32 in such manner that the roughness control loop 30 is used to produce the control signal on conductor 22 until the oxygen control loop is in operative condition and then it causes operation of the switching means to utilize the oxygen loop for producing the control signal on conductor 22.

The engine roughness control loop 30 is suitably of a type known in the prior art. In particular, the engine roughness detector may be of the type disclosed in the Taplin et al patent 3,789,816. As such, the engine roughness detector 30 comprises the speed sensor 18 which is suitably a tachometer which generates a signal having a voltage corresponding to crankshaft speed. The output of the speed sensor 18 is applied to a filter and double differentiator 36. The filter attenuates the frequencies of the speed signal outside a desired band and the filtered speed signal is differentiated to provide an output signal which is the second time derivative of the speed signal. The output of the differentiator is applied to a rectifier 38 which produces an output signal of the same polarity for both the acceleration and deceleration signals. The output of the rectifier 38 is applied to one input of a comparator 42 for comparison with a roughness reference signal which is applied to the other input of the comparator 42. The comparator 42 produces a roughness control signal voltage which is of positive polarity when the roughness signal is greater than the roughness reference signal and which is of negative polarity when the roughness signal is less than the reference roughness signal. The magnitude of the roughness control signal developed by the comparator 42 corresponds with the difference between the roughness signal and reference signal. The output of the comparator 42 is applied to the switching means 32. The output of the switching means 32 is applied to the input of an integrator 46 which generates an air-fuel control signal which is applied to the controller 12 on the conductor 22.

Figure 2:
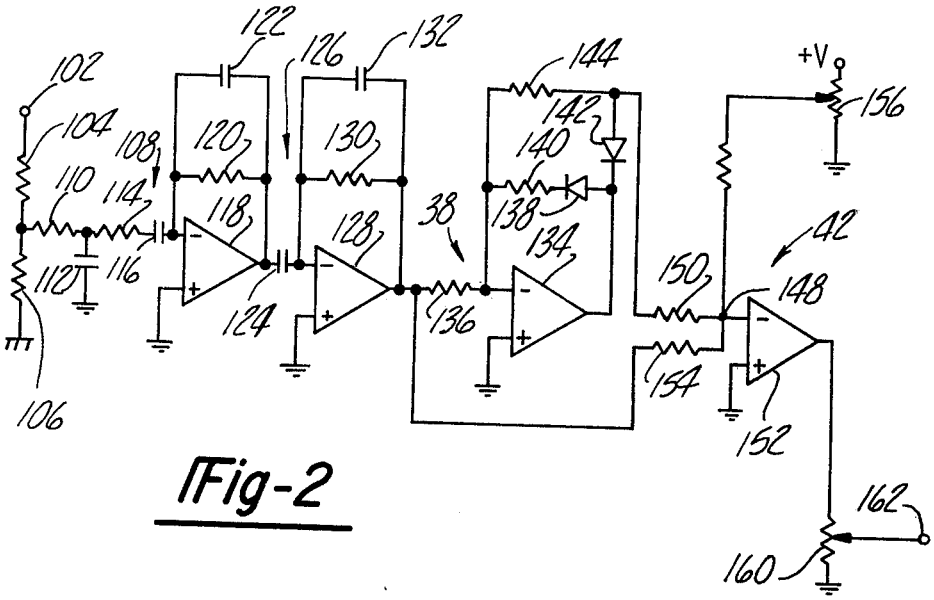
FIG. 2 is a schematic diagram of a roughness detector circuit.

The roughness detector 30 will now be described in greater detail with reference to the schematic diagram of FIG. 2. The output signal of the speed sensor 18 is applied between terminal 102 and chassis ground across voltage divider resistors 104 and 106. The speed signal, derived from the junction of the resistors is applied to a first differentiator 108 through a filter circuit comprising a series resistor 110, a shunt capacitor 112, a series resistor 114 and series capacitor 116. The differentiator 108 comprises an operational amplifier 118 which receives the output of the filter circuit on it's inverting input. The non-inverting input of the amplifier 118 is connected to a point of reference potential which is at a fixed voltage above chassis ground. The output of the amplifier 118 is applied through a feedback resistor 120 and a feedback capacitor 122 to the inverting input. The output of the operational amplifier 118 is a signal corresponding to the first time derivative of the speed signal. This output signal is applied through a capacitor 124 to the input of a second differentiator 126. The second differentiator comprises an operational amplifier 128 which has its inverting input connected with the output of the first differentiator. The non-inverting input of the amplifier 128 is connected to the point of reference potential. The output of the amplifier 128 is connected through a feedback resistor 130 and a feedback capacitor 132 to the inverting input. The differentiator 126 produces an output signal which corresponds to the second derivative of the speed signal.

The output signal from the differentiator 126 is applied to the input of the rectifier 38. The rectifier 38 comprises an operational amplifier 134 which receives the output of the differentiator 126 on its inverting input through a resistor 136. The non-inverting input of the amplifier 134 is connected to the point of reference potential. The output of the amplifier 134 is connected through a first feedback path including a diode 138 and resistor 140 to the inverting input and is also connected through a second feedback path through an oppositely poled diode 142 and a resistor 144 to the inverting input. The output voltage of the differentiator 126 is rectified by the rectifier 38 and the rectified voltage is developed at the node 146. The voltage at the node 146 is applied to a summing node 148 through a resistor 150. The comparator 42 comprises a operational amplifier 152 having its inverting input connected with the summing node 148. Also the output of the differentiator 126 is connected with the summing node 148 through a resistor 154. The roughness reference signal is developed by a potentiometer 156 and is applied through a resistor 158 to the summing node 148. The non-inverting input of the operational amplifier 152 is connected to the point of reference potential. The output of the operational amplifier 152 is applied across a potentiometer 160 and the engine roughness control signal is developed on the terminal 162 of the potentiometer. With the roughness reference signal set to the desired roughness threshold value by the potentiometer 156, the comparator 42 is operative to produce roughness control signal of positive polarity at the output of amplifier 152 when the engine roughness exceeds the threshold value. On the other hand, when the engine roughness is less than the threshold value, the output of the operational amplifier 152 is a signal voltage of negative polarity. The use of the engine roughness control signal developed on terminal 162 for control of the air-fuel will be described subsequently.

Reverting now to FIG. 1, the oxygen control loop will be described with reference to the block diagram. An oxygen sensor 52 is disposed downstream of the catalytic converter 54 in the path of the exhaust gases discharged from the engine. The sensor 52 is suitably a zirconium oxide device of known construction. The oxygen sensor is connected through a conductor 54 to the input of an oxygen signal circuit 56 which develops an oxygen control signal. The output of the circuit 56 is applied to one input of a comparator 58 which has its other input connected with a source providing an oxygen reference signal. The comparator 58 develops an oxygen control signal which is applied to one input of the switching means 32.

The oxygen control loop will be described in greater detail with reference to the schematic diagram in FIG. 3. The oxygen sensor 52 is connected with the input terminal 170 of the oxygen signal circuit 56. This circuit comprises a field effect transistor (FET) 172 and NPN bipolar transistor 174. The FET 172 has its gate connected with the input terminal 170, its source connected with the collector of the transistor 174 and its drain connected with the base of transistor 174. The emitter of the transistor 174 is connected to chassis ground through a resistor 176. The output of the transistor 174 is taken from the emitter and applied through a resistor 178 to a summing node 180. The oxygen reference signal is developed by a potentiometer 182 to establish a threshold value of oxygen corresponding to a given air-fuel ratio. The oxygen reference signal is applied through a resistor 184 to the summing node 180. As the oxygen content in the exhaust gases increases, the FET 172 becomes more conductive and the transistor 174 becomes more conductive. Consequently the oxygen signal voltage at the emitter of transistor 174 increases. The comparator 58, which develops an oxygen control signal, comprises an operational amplifier 186 having its inverting input connected with the node 180. The non-inverting input of the amplifier 186 is connected to the point of reference potential. When the oxygen content of the exhaust gases is below the threshold value, the oxygen signal is less than the oxygen reference signal and the oxygen control signal developed by the operational amplifier 186 is of negative polarity with a magnitude corresponding to the difference. When the oxygen signal is greater than the oxygen reference signal, the oxygen control signal is of positive polarity with a magnitude corresponding to the difference. The output of the operational amplifier 186 is applied across potentiometer 188 and the oxygen control signal is developed on the potentiometer output terminal 190. The manner in which the oxygen control signal is used to control the air-fuel ratio will be described subsequently.

Reverting again to FIG. 1, the temperature responsive control circuit 34 was described above as a control means for the switching circuit 32. For this purpose, a temperature sensor 60 is disposed in the engine 10 preferably in the coolant passages, and is responsive to the temperature of the coolant. The sensor is electrically connected with the temperature responsive control circuit 34 through a conductor 62. The output of the temperature control circuit 34 is applied through a conductor 64 to a control input of the switching means 32. The temperature responsive circuit 34 and the switching means 32 will be described in greater detail below.

FIG. 4, which represents the closed loop control system with alternate switching of the roughness loop and the oxygen loop for producing the control signal for the controller will now be described. It is noted that the system comprises the roughness loop including the roughness detector circuit 30 and the oxygen loop which includes the oxygen sensor circuit 50. These control loops are alternately connected through the switching means 32 under the control of the temperature responsive circuit 34, to the input of the integrator 46. The integrator 46 develops a control signal on conductor 22 for the air-fuel ratio controller 12. The system also includes an engine cranking signal circuit 200. The system, as shown in FIG. 4, will now be described in detail.

For the purpose of facilitating engine starting, the engine cranking signal circuit 200 is provided to supply an override control signal to the integrator 46 during engine cranking. An override control voltage is developed by potentiometer 214 and is applied to the input of the integrator 46 during cranking of the engine. For this purpose, the potentiometer 214 is connected through a resistor 216 and a FET 212 to a node 218 at the input of the integrator 46. An engine cranking signal is applied to a terminal 204 across a pair of voltage divider resistors 206 and 208. The cranking signal circuit 200 includes an NPN transistor 202. The base of the transistor 202 is connected to the junction of the voltage divider resistors and the emitter is connected to chassis ground. The collector of the transistor 202 is connected through a resistor 210 to a supply voltage source. When the engine is being cranked, a cranking signal voltage of positive polarity is applied to the terminal 204 and the transistor 202 is conductive. The output of the transistor 202 is taken from the collector and is applied to the gate of the FET 212. Thus, during cranking, with the transistor 202 turned on, the output signal thereof is low and the FET 212 is switched on and the override control signal is applied to the node 218.

The integrator 46 comprises an operational amplifier 220 having its inverting input connected with the node 218 and non-inverting input connected to the point of reference potential. The integrator 46 also comprises a feedback capacitor 222 connected between its output and its inverting input. The integrator also includes a feedback resistor 224 connected between the output and the inverting input through the FET 212. The integrator 46 is operative to produce a control signal on the conductor 22 which, as described above, is applied to the air-fuel ratio controller 12. During the engine cranking period, the FET 212 is turned on and a positive override voltage from the potentiometer 214 is applied therethrough to the inverting input of the amplifier 220. This causes the integrator 46 to produce a positive control voltage on the conductor 22. This positive control voltage on conductor 22 causes the controller 12 to produce injector pulses of increased duration and thereby producing a decreased air-fuel ratio, i.e. a richer fuel mixture. After the engine is started, the cranking signal is no longer present on terminal 204 and the transistor 202 is turned off. Consequently the FET 212 is turned off and the override signal from the potentiometer 214 is removed from the input of the integrator 46. In this condition, the input to the integrator 46 is selectably controlled by the temperature responsive circuit 34 through the switching means 32 which will now be described.

The temperature responsive circuit 34, as described above, controls the switching means 32 which in turn selectively connects the roughness detector circuit 30 or the oxygen sensor circuit 50 to the input of integrator 46. For the purpose of connecting the roughness detector circuit 30 to the integrator, the switching means includes a FET 230. The output of the roughness detector circuit 30 is connected through a resistor 232 and through the source and drain of the FET 230 to the node 218 at the input of the integrator 46. Similarly, for the purpose of connecting the oxygen sensor circuit 50 with the integrator 46, the switching means 32 includes a FET 234. The output of the oxygen sensor circuit is connected through a resistor 236 and through the source and drain of the FET 234 to the node 218 at the input of the integrator.

As described above, the temperature sensor 60 develops a signal which indicates whether the oxygen sensor is in an operative condition. In particular, this condition is caused by measuring the engine temperature as indicated by the temperature of the engine coolant. As a practical matter, when the engine has reached a certain operating temperature, the exhaust gases of the engine flowing over the oxygen sensor will have raised the temperature of the oxygen sensor to a value which renders it operative. It will be appreciated that the same result could be achieved placing a temperature sensor adjacent the oxygen sensor and thus make a direct determination of its operative condition by measuring its temperature. Also, the operative state of the oxygen sensor may be determined as set forth in the above identified Oberstadt U.S. Pat. No. 3,938,479.

The temperature sensor 60 is a thermistor, as shown in FIG. 4. The sensor 60 is connected across a voltage source through a resistor 238 and the temperature signal is derived from the junction 240. The temperature responsive circuit comprises a comparator 242 and an inverter 244. The comparator 242 includes a operational amplifier 246. The temperature signal from the junction 240 is applied through a resistor 248 to the inverting input of the amplifier 246. The non-inverting input of the amplifier is connected to the point of reference potential. The temperature reference signal is developed by a potentiometer 250 and has a voltage value which corresponds to the threshold temperature at which the oxygen sensor is in its operative state. The temperature reference signal is applied to the inverting input of the amplifier 246. The output of the operational amplifier 246 is applied across a pair of resistors 252 and 254. The invertor 244 comprises an NPN resistor 256 having its base connected with the junction of the resistors 252 and 254, its emitter connected to ground and its collector connected to a source of voltage through a resistor 258. The output of the inverter 244 is taken from the collector and is applied through a diode 260 to the gate of the FET 234. The output of the operational amplifier 246, in addition to being applied to the inverter 244 is applied through a diode 262 to the gate of the FET 230. When the temperature of the engine is below the threshold value, the output of the operational amplifier 246 is of negative polarity and the output of the inverter 244 is of positive polarity and the magnitude of these output voltages corresponds with the magnitude of the difference between the temperature signal and the reference temperature signal. When the engine temperature is above the threshold temperature, the output of the operational amplifier 246 is of positive polarity and the output of the inverter 244 is of negative polarity and the magnitude of the voltages corresponds with the difference in magnitude of the temperature signal and the reference temperature signal.

With the engine temperature below the threshold value, as explained above, the temperature responsive circuit develops a positive voltage at the output of the inverter 244. This is effective to turn off the FET 234 and hence the output of the oxygen sensor circuit 50 is isolated from the input of the integrator 46. In this condition, the output of the operational amplifier 246 is a negative voltage and, at a predetermined value, the FET 230 is turned on. Consequently, the output of the roughness detector circuit 30 is appllied through the FET 230 to the node 218 at the input of the integrator 46. With the FET 230 turned on, the integrator 46 is provided with a feedback network 264. This network includes a pair of potentiometers 266 and connected in series across a voltage source. The output of the operational amplifier 220 is connected to the junction of the potentiometers 266 and 268. The movable contact of the potentiometer 266 is connected through a diode 270 and the FET 230 to the node 218 at the input of the operational amplifier 220. Similarly, a movable contact of the potentiometer 268 is connected through a diode 272, which is reversely poled relative to diode 270, and through the FET 230 the node 218 at the input of the integrator 46. By this arrangement, the feedback resistance for the integrator 46 may be set at a desired value for a positive output voltage and at a different desired value for a negative output voltage. Thus, the FET 230 isd turned on by the temperature responsive circuit 34 before the engine is warmed up, the control signal on the conductor 22 at the output of the integrator 46 is developed by the closed loop including the roughness detector circuit 30.

When the engine is running with a roughness greater than the threshold value, the roughness control signal is of positive polarity and a magnitude corresponding to the degree of roughness. This is indicative of an air-fuel ratio that is too lean, since the roughness reference signal is set for operation at the lean limit of fuel-air ratio which gives satisfactory driveability as to engine roughness and minimizes the engine exhause emissions. The roughness control signal of positive polarity causes the output integrator 46 to become more positive. This causes the controller 12 to increase the quantity of fuel and this decreases the air-fuel ratio until the roughness control signal is reduced to the reference value. When the roughness control signal is negative, indicating smooth running engine operation and indicating an unnecessarily rich air-fuel mixture, the output of the integrator 46 becomes less positive. This causes the controller 12 to decrease the quantity of fuel until the roughness control signal is increased to the reference value.

When the temperature of the engine exceeds the threshold value, the output of the operational amplifier 246 is of positive polarity and the FET 230 is turned off. In this condition the output voltage of the inverter 244 is of negative polarity and the FET 234 is turned on and the output of the oxygen sensor circuit 50 is applied through the FET 234 to the node 218 at the input of the integrator 46. With the FET 234 turned on the integrator 46 is provided with a feedback network 274. The network 274 comprises a pair of potentiometers 276 and 278 connected in series across a voltage source. The output of the operational amplifier 220 is connected to the junction between the potentiometers. The movable contact of the potentiometer 276 is connected through a diode 280 and the FET 234 to the inverting input of the amplifier 220. A movable contact of the potentiometer 278 is connected through a diode 282 and the FET 234 to the node 218. It is noted that the diode 282 is reversely poled relative to the diode 280. This arrangement permits the feedback resistance of the integrator 46 to be set at one value for a positive output signal and a different value for a negative output signal of the operational amplifier 220. Accordingly, when the temperature of the engine is above the threshold value the FET 230 is turned off and the FET 234 is turned on. In this condition, the control signal from conductor 22 at the output of the integrator 46 is developed by the closed loop control system including the oxygen sensor circuit 50. When the air-fuel mixture supplied to the engine is too lean, the oxygen sensor circuit 50 will produce an oxygen signal of positive polarity. This oxygen signal is appllied to the integrator 46 and causes the output thereof to become more positive. This causes the air-fuel ratio controller 12 to increase the quantity of fuel and change the air-fuel ratio toward the desired value. When the oxygen signal is negative the control signal produced by the integrator 46 becomes more negative and causes the controller 12 to decrease the quantity of fuel and change the ratio toward the desired value.

The operation, as described above, may be summarized as follows. When the engine is being cranked, the cranking signal circuit 200 turns on the FET 212 and a positive override signal voltage is applied through the FET 212 to the input of the integrator 46. This positive override signal at the input of the integrator produces a positive control signal on conductor 22 and the controller 12 increases the fuel quantity to supply a sufficiently rich mixture for engine starting. With the engine running, the cranking signal is removed and the FET 212 is turned off. Before the engine is warmed up the temperature of the oxygen sensor will be below its operating temperature and the temperature signal will be below the reference temperature signal. Accordingly, the temperature responsive circuit 34 will produce a negative voltage at the output of the amplifier 246 and a positive voltage at the output of the inverter 244. This will turn off the FET 234 and turn on the FET 230. Accordingly, during the engine warm up period and at any time when the oxygen sensor is below its operating temperature, the roughness signal from the detector circuit 30 will be applied through the FET 230 to the integrator 46. The air-fuel ratio supplied to the engine will be controlled by the closed loop control system including the roughness detector circuit 30 during the engine warm up period. After the oxygen sensor has reached its operative temperature, as indicated by the temperature responsive circuit 34, the FET 230 will be switched off and the FET 234 will be turned on. The oxygen signal developed by the sensor circuit 50 will be applied through the FET 234 to the input of the integrator 46. In this condition the air-fuel ratio supplied to the engine is controlled by the closed loop control system including the oxygen sensor circuit 50.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. A system for producing a control signal for an air-fuel ratio controller for an internal combustion engine comprising:

an oxygen sensor for generating a first signal indicative of the oxygen content of the exhaust gases emitted by the engine;

first means responsive to said first signal for producing a first control signal corresponding to a change in the air-fuel ratio required to maintain the air-fuel ratio provided by the air-fuel ratio controller near the stoichiometric value;

second sensor means sensing a mechanical output of the engine for generating a second signal having a value indicative of the air-fuel ratio being supplied to the engine;

second means responsive to said second signal for producing a second control signal corresponding to a change in the air-fuel ratio provided by said air-fuel ratio controller to maintain the air-fuel ratio at a predetermined value;

means for generating a third signal having a value indicative of the temperature of said oxygen sensor; and switching means responsive to said third signal for coupling said first means to said air-fuel ratio controller when said third signal is indicative of a temperature above a predetermined value and for coupling said second means to said air-fuel ratio controller when said third signal is indicative of a temperature below said predetermined value.

2. The system of claim 1 wherein said means for generating a third signal is a temperature sensor.

3. The system of claim 2 wherein said temperature sensor senses a temperature indicative of the temperature of the engine.

4. The system of claim 1 wherein engine roughness is indicative of the air-fuel ratio being supplied to the engine by the air-fuel ratio controller, said second sensor means is an engine roughness sensor and said second signal has a value indicative of engine roughness; and wherein said second means produces said second control signal corresponding to a change in the air-fuel ratio required to maintained the engine roughness at a predetermined value.

* * * * *